US010926549B2

(12) United States Patent
Tsukahara

(10) Patent No.: US 10,926,549 B2
(45) Date of Patent: Feb. 23, 2021

(54) INKJET PRINTER AND CONTROL METHOD FOR INKJET PRINTER

(71) Applicant: MIMAKI ENGINEERING CO., LTD., Nagano (JP)

(72) Inventor: Shota Tsukahara, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 16/548,816

(22) Filed: Aug. 22, 2019

(65) Prior Publication Data

US 2020/0070533 A1 Mar. 5, 2020

(30) Foreign Application Priority Data

Aug. 29, 2018 (JP) ..... JP2018-159958

(51) Int. Cl.
*B41J 2/175* (2006.01)

(52) U.S. Cl.
CPC ..... *B41J 2/17566* (2013.01)

(58) Field of Classification Search
CPC ..... B41J 2/17566; B41J 2/17596; B41J 2/18; B41J 2/175; B41J 2/19; B41J 2/195; B41J 2/20; B41J 2002/17569; B41J 2002/17573; B41J 2002/17576; B41J 2002/17579; B41J 2002/17583; B41J 2002/17586; B41J 2002/17589
See application file for complete search history.

(56) References Cited

FOREIGN PATENT DOCUMENTS

| | | |
|---|---|---|
| EP | 3287288 | 2/2018 |
| EP | 3339038 | 6/2018 |
| JP | 2010083021 | 4/2010 |

OTHER PUBLICATIONS

"Search Report of Europe Counterpart Application", dated Jan. 2, 2020, p. 1-p. 10.

*Primary Examiner* — Kristal Feggins
(74) *Attorney, Agent, or Firm* — JCIPRNET

(57) ABSTRACT

In an inkjet printer, when an amount of ink in a supply side sub tank is an appropriate amount and an amount of ink in the discharge side sub tank is an appropriate amount, the ink is supplied from the discharge side sub tank to the supply side sub tank at a constant flow rate by an ink pump. Furthermore, the inkjet printer acquires a first pump driving speed, which is the driving speed of the ink pump at this time, at a predetermined time interval, and compares the first pump driving speed with a predetermined reference speed, and executes a predetermined error processing when the first pump driving speed exceeds a reference speed.

7 Claims, 3 Drawing Sheets

INKJET PRINTER AND CONTROL METHOD FOR INKJET PRINTER

CROSS REFERENCE TO RELATED APPLICATIONS

This application claims the priority benefit of Japanese Patent Application No. 2018-159958, filed on Aug. 29, 2018. The entirety of the above-mentioned patent application is hereby incorporated by reference herein and made a part of this specification.

TECHNICAL FIELD

The present disclosure relates to an inkjet printer equipped with an ink circulation type inkjet head. The present disclosure also relates to a control method for such an inkjet printer.

DESCRIPTION OF RELATED ART

Conventionally, an inkjet recording apparatus equipped with an ink circulation type recording head (head) has been known (see e.g., Japanese Unexamined Patent Publication No. 2010-83021). In the inkjet recording apparatus described in Japanese Unexamined Patent Publication No. 2010-83021, an ink supply system for supplying the ink to the recording head includes a main tank, a buffer tank, a supply sub tank, and a collecting sub tank. The supply sub tank is connected to a supply port of the recording head through a piping, and the collecting sub tank is connected to a discharge port of the recording head through a piping.

Furthermore, in the inkjet recording apparatus described in Japanese Unexamined Patent Publication No. 2010-83021, the supply sub tank is connected to the main tank through the buffer tank. A pump for supplying ink to the supply sub tank is installed in a flow path between the buffer tank and the supply sub tank. The collecting sub tank is connected to the main tank through the buffer tank and to the supply sub tank. A pump for feeding the ink from the collecting sub tank to the supply sub tank is installed in a flow path between the collecting sub tank and the supply sub tank.

In the inkjet recording apparatus described in Japanese Unexamined Patent Publication No. 2010-83021, ink is supplied from the supply sub tank to the recording head and the ink is discharged from the recording head to the collecting sub tank by the difference between the pressure inside the supply sub tank and the pressure inside the collecting sub tank, so that the ink circulates inside the recording head. Furthermore, in the inkjet recording apparatus, the ink discharged from the recording head to the collecting sub tank is fed from the collecting sub tank to the supply sub tank by a pump.

SUMMARY

In the inkjet recording apparatus described in Japanese Unexamined Patent Publication No. 2010-83021, when an ejection performance of the pump for feeding the ink from the collecting sub tank to the supply sub tank is lowered due to aging deterioration and the like, and the feeding amount of ink fed from the collecting sub tank to the supply sub tank is reduced, an overflow error in which the ink in the collecting sub tank exceeds a predetermined amount or a supply error in which the ink in the supply sub tank becomes less than a predetermined amount may occur, and the inkjet recording apparatus may stop during printing.

If the above-described error occurs in the inkjet recording apparatus described in Japanese Unexamined Patent Publication No. 2010-83021 and the inkjet recording apparatus is stopped during printing, subsequent printing cannot be performed and the medium being printed may become a waste. Furthermore, when shaping a three-dimensional object with the inkjet recording apparatus described in Japanese Unexamined Patent Publication No. 2010-83021, if the above-mentioned error occurs and the inkjet recording apparatus is stopped during printing, the shaped object in the middle of being shaped until the inkjet recording apparatus is stopped may become a waste. Furthermore, when the inkjet recording apparatus is for business use, the inkjet recording apparatus may not be usable until a maintenance person completes predetermined work such as replacement of the pump after the inkjet recording apparatus is stopped.

Therefore, the present disclosure provides an inkjet printer including an ink circulation type inkjet head, a supply side sub tank that contains ink to be supplied to the inkjet head, a discharge side sub tank that contains ink discharged from the inkjet head, and an ink pump that feeds the ink from the discharge side sub tank to the supply side sub tank, the inkjet printer capable of preventing the inkjet printer from stopping by the decrease in the feeding amount of the ink of the ink pump, and a control method for the inkjet printer.

In view of the above descriptions, an inkjet printer of the present disclosure is an inkjet printer including: an ink circulation type inkjet head having an ink supply port for supplying ink, an ink discharge port for discharging ink, and a nozzle unit for ejecting ink; a supply side sub tank that is connected to the ink supply port through a piping and that contains the ink to be supplied to the inkjet head; a discharge side sub tank that is connected to the ink discharge port through a piping and that contains the ink discharged from the inkjet head; a first detection mechanism for detecting an amount of the ink in the supply side sub tank; a second detection mechanism for detecting an amount of the ink in the discharge side sub tank; and an ink pump that feeds the ink from the discharge side sub tank to the supply side sub tank based on detection results of the first detection mechanism and the second detection mechanism. The ink inside the inkjet head is caused to circulate by that a negative pressure inside the discharge side sub tank is a negative pressure larger than a negative pressure inside the supply side sub tank, and the ink moves from the supply side sub tank to the discharge side sub tank through the inkjet head. In a case that a state of the inkjet printer when the first detection mechanism detects that the amount of the ink in the supply side sub tank is an appropriate amount, and the second detection mechanism detects that the amount of the ink in the discharge side sub tank is an appropriate amount is referred to as an ink appropriate amount state the ink is supplied from the discharge side sub tank to the supply side sub tank at a constant flow rate by the ink pump when the inkjet printer is in the ink appropriate amount state. A control unit of the inkjet printer acquires a first pump driving speed, which is a driving speed of the ink pump, when the inkjet printer is in the ink appropriate amount state at a predetermined time interval and compares the first pump driving speed with a predetermined reference speed, and executes a predetermined error processing when the first pump driving speed exceeds the reference speed.

Furthermore, in view of the above descriptions, a control method for an inkjet printer of the present disclosure is a control method for an inkjet printer, the inkjet printer including: an ink circulation type inkjet head having an ink supply port for supplying ink, an ink discharge port for discharging ink, and a nozzle unit for ejecting ink; a supply side sub tank that is connected to the ink supply port through a piping and that contains the ink to be supplied to the inkjet head; a discharge side sub tank that is connected to the ink discharge port through a piping and that contains the ink discharged from the inkjet head; a first detection mechanism for detecting an amount of the ink in the supply side sub tank; a second detection mechanism for detecting an amount of the ink in the discharge side sub tank; and an ink pump that feeds the ink from the discharge side sub tank to the supply side sub tank based on detection results of the first detection mechanism and the second detection mechanism. The ink inside the inkjet head is caused to circulate by that a negative pressure inside the discharge side sub tank is a negative pressure larger than a negative pressure inside the supply side sub tank, and the ink moves from the supply side sub tank to the discharge side sub tank through the inkjet head. In a case that a state of the inkjet printer when the first detection mechanism detects that the amount of the ink in the supply side sub tank is an appropriate amount and the second detection mechanism detects that the amount of the ink in the discharge side sub tank is an appropriate amount is referred to as an ink appropriate amount state, the ink is supplied from the discharge side sub tank to the supply side sub tank at a constant flow rate by the ink pump when the inkjet printer is in the ink appropriate amount state. The control method including steps of: a pump speed check step of acquiring a first pump driving speed, which is a driving speed of the ink pump when the inkjet printer is in the ink appropriate amount state at a predetermined time interval and comparing the first pump driving speed with a predetermined reference speed; and an error processing execution step of executing a predetermined error processing when the first pump driving speed exceeds the reference speed.

In the present disclosure, in a case that a state of the inkjet printer when the first detection mechanism detects that the amount of the ink in the supply side sub tank is an appropriate amount, and the second detection mechanism detects that the amount of the ink in the discharge side sub tank is an appropriate amount is referred to as an ink appropriate amount state, the ink is supplied from the discharge side sub tank to the supply side sub tank at a constant flow rate by the ink pump when the inkjet printer is in the ink appropriate amount state. Furthermore, in the present disclosure, the first pump driving speed, which is a driving speed of the ink pump, when the inkjet printer is in the ink appropriate amount state is acquired at a predetermined time interval and compared with a predetermined reference speed, and a predetermined error processing is executed when the first pump driving speed exceeds the reference speed. Therefore, in the present disclosure, the user of the inkjet printer can sense that the ejection performance of the ink pump is starting to degrade before the ejection performance of the ink pump is degraded to an extent the inkjet printer comes to a stop.

That is, since the ink is supplied from the discharge side sub tank to the supply side sub tank at a constant flow rate by the ink pump when the inkjet printer is in the ink appropriate amount state, the first pump driving speed which is the driving speed of the ink pump in the ink appropriate amount state becomes faster as the ejection performance of the ink pump degrades. Therefore, as in the present disclosure, the first pump driving speed is acquired at a predetermined time interval and compared with a predetermined reference speed, and a predetermined error processing is executed when the first pump driving speed exceeds the reference speed, so that the user of the inkjet printer can sense that the ejection performance of the ink pump is starting to degrade before the ejection performance of the ink pump degrades to an extent the inkjet printer comes to a stop. Therefore, in the present disclosure, when the user senses that the ejection performance of the ink pump is starting to degrade, the user carries out a predetermined operation such as maintenance or replacement of the ink pump to prevent the inkjet printer from stopping by the decrease in the feeding amount of the ink of the ink pump.

In the present disclosure, preferably, in a case that a state of the inkjet printer when ink is not ejected from the nozzle unit before start of printing or after end of printing is referred to as a standby state, the pump speed check step is in an executable state when a predetermined first time has elapsed in the standby state. Although the driving speed of the ink pump that feeds the ink from the discharge side sub tank to the supply side sub tank based on the detection results of the first detection mechanism and the second detection mechanism is less likely to stabilize before a fixed time has elapsed after activation of the inkjet printer or before a fixed time has elapsed after end of printing, the driving speed of the ink pump easily stabilizes after elapse of a predetermined first time in the standby state. Therefore, with such a configuration, the first pump driving speed can be appropriately acquired in the pump speed check step.

In the present disclosure, preferably, in a case that a state of the inkjet printer when the first detection mechanism detects that the amount of the ink in the supply side sub tank exceeds a predetermined reference amount and the second detection mechanism detects that the amount of the ink in the discharge side sub tank exceeds the predetermined reference amount is referred to as an ink excess state, the pump speed check step is executed when the inkjet printer is not in the ink excess state and the inkjet printer is in the ink appropriate amount state until a predetermined second time has further elapsed from the elapse of the first time in the standby state.

When the inkjet printer is in the ink excess state, the amount of the ink in the discharge side sub tank needs to be reduced and the amount of ink in the supply side sub tank also needs to be reduced, and hence the driving speed of the ink pump is unstable if the inkjet printer is in the ink excess state even after the first time has elapsed in the standby state, but the driving speed of the ink pump easily stabilizes if the inkjet printer is not in the ink excess state until a predetermined second time has further elapsed from the elapse of the first time in the standby state. Therefore, with such a configuration, the first pump driving speed can be appropriately acquired in the pump speed check step.

In the present disclosure, preferably, in the error processing execution step, an error state is registered in a control unit of the inkjet printer; and in the pump speed check step executed after the error processing execution step, the error state registered in the control unit is canceled when the first pump driving speed is less than or equal to the reference speed. With such a configuration, when an error occurs such as the first pump driving speed acquired in the previous pump speed check step being inappropriate, or the comparison result between the first pump driving speed and the reference speed in the previous pump speed check step being inappropriate, and the like, such error can be corrected.

As described above, in the present disclosure, in an inkjet printer including an ink circulation type inkjet head, a supply side sub tank that contains ink to be supplied to the inkjet head, a discharge side sub tank that contains ink discharged from the inkjet head, and an ink pump that feeds ink from the discharge side sub tank to the supply side sub tank, the inkjet printer can be prevented from stopping by the decrease in the feeding amount of the ink of the ink pump.

DETAILED DESCRIPTION OF EMBODIMENTS

Hereinafter, an embodiment of the present disclosure will be described with reference to the accompanying drawings.

(Configuration of Inkjet Printer)

Figure 1:
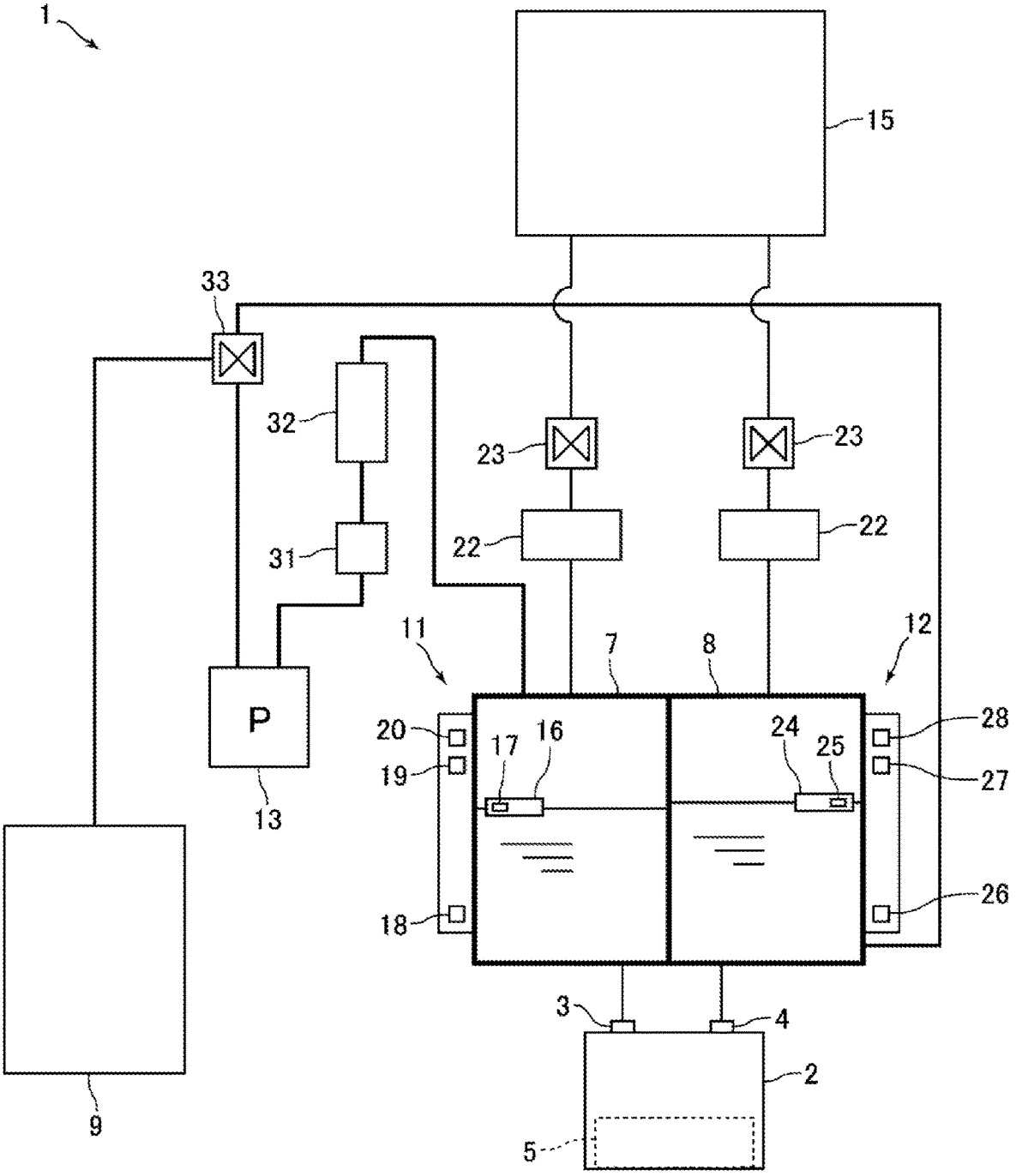
FIG. 1 is a schematic view for explaining a configuration of an inkjet printer according to an embodiment of the present disclosure.
Figure 2:
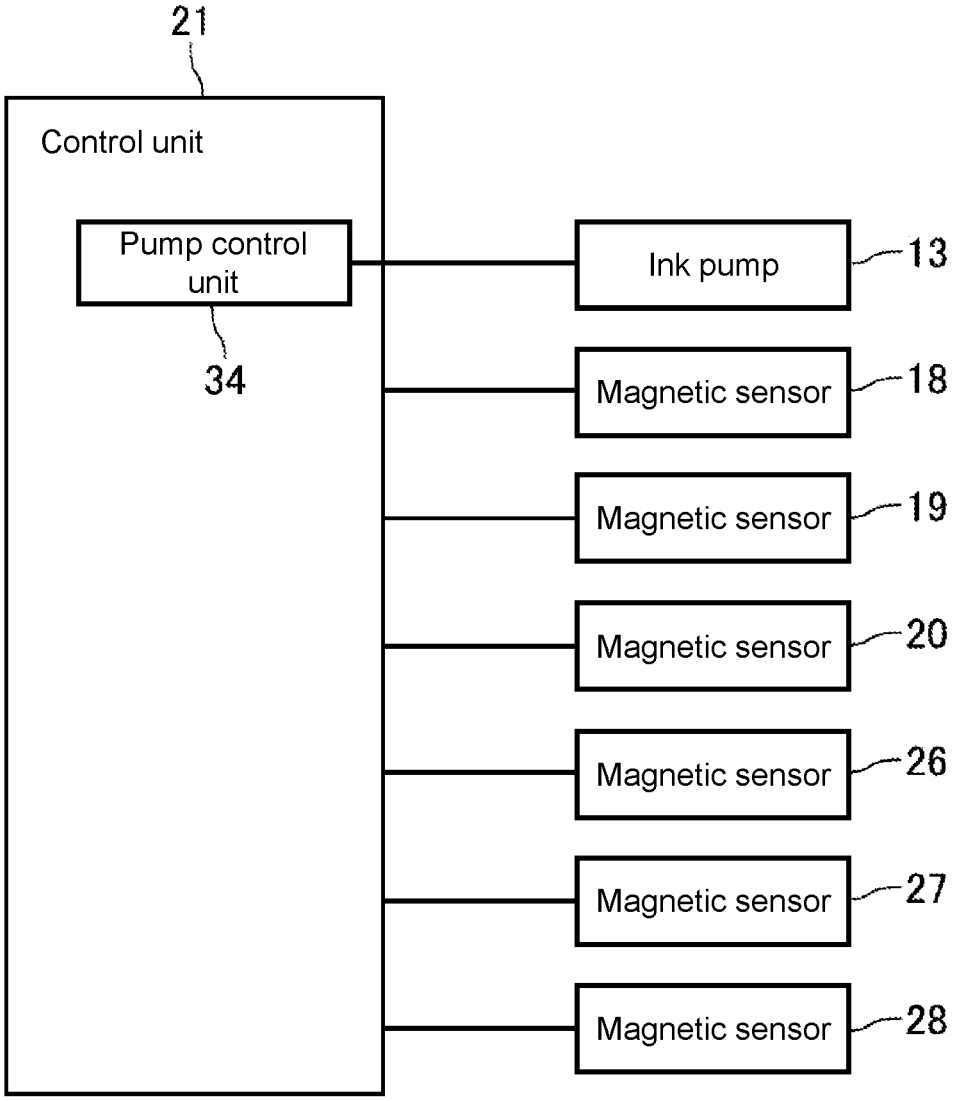
FIG. 2 is a block diagram for explaining the configuration of the inkjet printer shown in FIG. 1.

FIG. 1 is a schematic view for describing a configuration of an inkjet printer 1 according to an embodiment of the present disclosure. FIG. 2 is a block diagram for describing the configuration of the inkjet printer 1 shown in FIG. 1.

The inkjet printer 1 of the present embodiment (hereinafter, referred to as "printer 1") is an inkjet printer for business use. Furthermore, the printer 1 is a 3D printer for shaping a three-dimensional object. The printer 1 includes an inkjet head 2 (hereinafter, referred to as "head 2") that ejects ink. The head 2 of the present embodiment is an ink circulation type head that circulates the ink inside the head 2, and includes an ink supply port 3 to which the ink is supplied, an ink discharge port 4 from which the ink is discharged, and a nozzle unit 5 that ejects the ink. Thus, in the head 2, precipitation of the pigment of the ink can be prevented, and air bubbles which are the cause of nozzle slip-out can be removed.

The printer 1 also includes a carriage on which the head 2 is mounted, a carriage drive mechanism that moves the carriage in a main scanning direction, and a mounting stand on which a three-dimensional object is mounted. The mounting stand is disposed below the head 2. When a three-dimensional object is shaped by the printer 1, the head 2 ejects ink toward the mounting stand while the carriage reciprocates in the main scanning direction.

Furthermore, the printer 1 includes a supply side sub tank 7 that is connected to the ink supply port 3 through a piping and that contains ink to be supplied to the head 2, a discharge side sub tank 8 that is connected to the ink discharge port 4 through a piping and that contains ink to be discharged from the head 2, and a main tank 9 that contains ink to be supplied to the supply side sub tank 7. The printer 1 also includes a detection mechanism 11 for detecting the amount of ink in the supply side sub tank 7, a detection mechanism 12 for detecting the amount of ink in the discharge side sub tank 8, and an ink pump 13 that feeds the ink from the discharge side sub tank 8 to the supply side sub tank 7 based on the detection results of the detection mechanisms 11, 12. The detection mechanism 11 of the present embodiment is a first detection mechanism, and the detection mechanism 12 is a second detection mechanism.

The printer 1 includes a plurality of heads 2 and the plurality of heads 2 are mounted on the carriage. The printer 1 also includes a plurality of supply side sub tanks 7 and discharge side sub tanks 8 corresponding to the number of heads 2, a plurality of main tanks 9 corresponding to the number of supply side sub tanks 7, and a plurality of detection mechanisms 11 and 12, and a plurality of ink pumps 13 corresponding to the number of supply side sub tanks 7 and the discharge side sub tanks 8.

The supply side sub tank 7 and the discharge side sub tank 8 are mounted on the carriage. Furthermore, the supply side sub tank 7 and the discharge side sub tank 8 are disposed above the head 2. The supply side sub tank 7 and the discharge side sub tank 8 are integrally formed. Specifically, the inside of one sub tank is divided into the supply side sub tank 7 and the discharge side sub tank 8. The supply side sub tank 7 and the discharge side sub tank 8 may be formed with separate bodies.

A pressure control unit 15 for controlling the internal pressure of the supply side sub tank 7 and the internal pressure of the discharge side sub tank 8 is connected to the supply side sub tank 7 and the discharge side sub tank 8. The pressure control unit 15 is connected to the supply side sub tank 7 and the discharge side sub tank 8 through a backflow prevention filter 22 and an open/close valve 23. The pressure control unit 15 includes a negative pressure pump for making the internal pressure of the supply side sub tank 7 to a negative pressure, and a negative pressure pump for making the internal pressure of the discharge side sub tank 8 to a negative pressure.

The internal pressure of the supply side sub tank 7 is higher than the internal pressure of the discharge side sub tank 8. That is, the negative pressure inside the discharge side sub tank 8 is a negative pressure larger than the negative pressure inside the supply side sub tank 7. In the present embodiment, due to the difference between the internal pressure of the supply side sub tank 7 and the internal pressure of the discharge side sub tank 8, the ink is always supplied from the supply side sub tank 7 to the head 2 and the ink is discharged from the head 2 to the discharge side sub tank 8. That is, due to the difference between the internal pressure of the supply side sub tank 7 and the internal pressure of the discharge side sub tank 8, the ink moves from the supply side sub tank 7 to the discharge side sub tank 8 through the head 2, so that the ink inside the head 2 always circulates.

The detection mechanism 11 is a liquid level detection mechanism that detects the amount of ink in the supply side sub tank 7 by detecting the liquid level of the ink in the supply side sub tank 7. The detection mechanism 11 includes a float 16 disposed in the supply side sub tank 7, a magnet (permanent magnet) 17 incorporated in the float 16, and magnetic sensors 18 to 20 such as Hall IC for detecting the magnet 17. The detection mechanism 11 of the present embodiment includes three magnetic sensors 18 to 20. The magnetic sensors 18 to 20 are electrically connected to a control unit 21 of the printer 1.

The float 16 floats in the ink in the supply side sub tank 7. The magnetic sensors 18 to 20 are fixed to the outer side surface of the supply side sub tank 7. The magnetic sensors 18 to 20 are arrayed in the vertical direction, and are arranged in this order toward the upper side. Furthermore, the magnetic sensor 18 is fixed to the lower end side of the outer side surface of the supply side sub tank 7, and the magnetic sensors 19 and 20 are fixed to the upper end side of the outer side surface of the supply side sub tank 7.

In the present embodiment, the magnet 17 is detected by the magnetic sensor 18 when the amount of ink in the supply side sub tank 7 decreases, and the magnet 17 is detected by the magnetic sensor 19 when the amount of ink in the supply side sub tank 7 slightly increases, the magnet 17 is detected by the magnetic sensor 19 and the magnetic sensor 20 when the amount of ink in the supply side sub tank 7 increases, and the magnet 17 is detected by the magnetic sensor 20 when the amount of ink in the supply side sub tank 7 becomes excessively large. Furthermore, the magnet 17 is not detected by any of the magnetic sensors 18 to 20 when the amount of ink in the supply side sub tank 7 is an appropriate amount.

The detection mechanism 12 is a liquid level detection mechanism that detects the amount of ink in the discharge side sub tank 8 by detecting the liquid level of the ink in the discharge side sub tank 8. The detection mechanism 12 is configured similar to the detection mechanism 11, and includes a float 24 disposed in the discharge side sub tank 8, a magnet (permanent magnet) 25 incorporated in the float 24, and three magnetic sensors 26 to 28 such as Hall IC for detecting the magnet 25. The magnetic sensors 26 to 28 are electrically connected to the control unit 21.

The float 24 floats in the ink in the discharge side sub tank 8. The magnetic sensors 26 to 28 are fixed to the outer side surface of the discharge side sub tank 8. The magnetic sensors 26 to 28 are arrayed in the vertical direction, and are arranged in this order toward the upper side. Furthermore, the magnetic sensor 26 is fixed to the lower end side of the outer side surface of the discharge side sub tank 8, and the magnetic sensors 27 and 28 are fixed to the upper end side of the outer side surface of the discharge side sub tank 8.

In the present embodiment, the magnet 25 is detected by the magnetic sensor 26 when the amount of ink in the discharge side sub tank 8 decreases, and the magnet 25 is detected by the magnetic sensor 27 when the amount of ink in the discharge side sub tank 8 slightly increases, the magnet 25 is detected by the magnetic sensor 27 and the magnetic sensor 28 when the amount of ink in the discharge side sub tank 8 increases, and the magnet 25 is detected by the magnetic sensor 28 when the amount of ink in the discharge side sub tank 8 becomes excessively large. Furthermore, the magnet 25 is not detected by any of the magnetic sensors 26 to 28 when the amount of ink in the discharge side sub tank 8 is an appropriate amount.

The ink pump 13 is, for example, a diaphragm pump, and includes a motor as a drive source. The motor is, for example, a stepping motor. The ink pump 13 is disposed in a piping path between the discharge side sub tank 8 and the supply side sub tank 7. A filter 31 and a degassing module 32 are disposed in the piping path between the ink pump 13 and the supply side sub tank 7. The degassing module 32 removes air bubbles (gas) contained in the ink.

A three-way valve 33 is disposed in a piping path between the discharge side sub tank 8 and the ink pump 13. The main tank 9 is connected to the three-way valve 33 by way of a piping. In the present embodiment, normally, a flow path of the ink for the ink pump 13 to feed the ink from the discharge side sub tank 8 to the supply side sub tank 7 is formed, but if the amount of ink in the supply side sub tank 7 and the discharge side sub tank 8 decreases, the three-way valve 33 is switched and a flow path of the ink for the ink pump 13 to feed the ink from the main tank 9 to the supply side sub tank 7 is formed.

For example, when the amount of ink in the supply side sub tank 7 decreases and the magnet 17 is detected by the magnetic sensor 18, and the amount of ink in the discharge side sub tank 8 decreases and the magnet 25 is detected by the magnetic sensor 26, the three-way valve 33 is switched and a flow path of ink for the ink pump 13 to feed the ink from the main tank 9 to the supply side sub tank 7 is formed. Furthermore, for example, when the amount of ink in the supply side sub tank 7 decreases and the magnet 17 is detected by the magnetic sensor 18, and the amount of ink in the discharge side sub tank 8 is an appropriate amount and the magnet 25 is not detected by any of the magnetic sensors 26 to 28, the three-way valve 33 is switched and a flow path of ink for the ink pump 13 to feed the ink from the main tank 9 to the supply side sub tank 7 is formed.

The ink pump 13 is electrically connected to a pump control unit 34 that forms a part of the control unit 21. Specifically, a motor which is a drive source of the ink pump 13 is electrically connected to the pump control unit 34. The pump control unit 34 drives and controls the ink pump 13 based on the detection results of the detection mechanisms 11 and 12. Specifically, the pump control unit 34 drives and controls a motor which is a drive source of the ink pump 13.

Assuming a state of the printer 1 when the detection mechanism 11 detects that the amount of ink in the supply side sub tank 7 is an appropriate amount, and the detection mechanism 12 detects that the amount of ink in the discharge side sub tank 8 is an appropriate amount (i.e., when the magnet 17 is not detected by any of the magnetic sensors 18 to 20 and the magnet 25 is not detected by any of the magnetic sensors 26 to 28) is referred to as an "ink appropriate amount state", the ink pump 13 supplies the ink from the discharge side sub tank 8 to the supply side sub tank 7 at a constant flow rate when the printer 1 is in the ink appropriate amount state.

That is, the pump control unit 34 drives the ink pump 13 so that the ink is supplied from the discharge side sub tank 8 to the supply side sub tank 7 at a constant flow rate when the printer 1 is in the ink appropriate amount state. Furthermore, the driving speed of the ink pump 13 when the printer 1 is in the ink appropriate amount state is a predetermined first pump driving speed. That is, the pump control unit 34 drives the ink pump 13 at the first pump driving speed when the printer 1 is in the ink appropriate amount state.

Moreover, the pump control unit 34 drives the ink pump 13 so that the amount of ink in the supply side sub tank 7 and the amount of ink in the discharge side sub tank 8 become appropriate amounts. For example, when the amount of ink in the supply side sub tank 7 is an appropriate amount or is small, and the amount of ink in the discharge side sub tank 8 is somewhat large, the pump control unit 34 drives the ink pump 13 at a driving speed higher than the first pump driving speed. When the amount of ink in the supply side sub tank 7 is somewhat large and the amount of ink in the discharge side sub tank 8 is an appropriate amount or is small, the pump control unit 34 drives the ink pump 13 at a driving speed less than the first pump driving speed or stops the ink pump 13.

When the ink appropriate amount state continues for a fixed time, the flow rate of the ink supplied from the supply side sub tank 7 to the head 2 (hereinafter, this flow rate is referred to as a "first ink flow rate"), the flow rate of the ink discharged from the head 2 to the discharge side sub tank 8 (hereinafter, this flow rate is referred to as a "second ink flow rate"), and the flow rate of the ink supplied from the discharge side sub tank 8 to the supply side sub tank 7 by the ink pump 13 (hereinafter this flow rate is referred to as a "third ink flow rate") are a substantially equal constant flow rate. That is, when the ink appropriate amount state continues for a fixed time, the flow rate of the ink supplied from the discharge side sub tank 8 to the supply side sub tank 7 by the ink pump 13 and the flow rate of the ink moved from the supply side sub tank 7 to the discharge side sub tank 8 through the head 2 are in an equilibrium state. The driving speed of the ink pump 13 when the first ink flow rate, the second ink flow rate, and the third ink flow rate are a substantially equal constant flow rate is the first pump driving speed.

Furthermore, assuming the state of the printer 1 from the start of shaping by the printer 1 to the end of shaping (i.e., state in which the printer 1 is shaping a three-dimensional object) is referred to as a "printing state", and the state of the printer 1 when ink is not ejected from the nozzle unit 5 before the start of printing (i.e., before start of shaping) or after the end of printing (i.e., after end of shaping) is referred to as a "standby state", the first pump driving speed in the printing state is faster than the first pump driving speed in the standby state.

In the following description, the state of the printer 1 when the detection mechanism 11 detects that the amount of ink in the supply side sub tank 7 exceeds a predetermined reference amount, and the detection mechanism 12 detects that the amount of ink in the discharge side sub tank 8 exceeds a predetermined reference amount is referred to as an "ink excess state". Specifically, the state of the printer 1 when the amount of ink in the supply side sub tank 7 is somewhat large and the magnet 17 is detected by the magnetic sensor 19, and the amount of ink in the discharge side sub tank 8 is somewhat large and the magnet 25 is detected by the magnetic sensor 27 is referred to as an ink excess state.

(Checking Operation of Driving Speed of Ink Pump)

Figure 3:
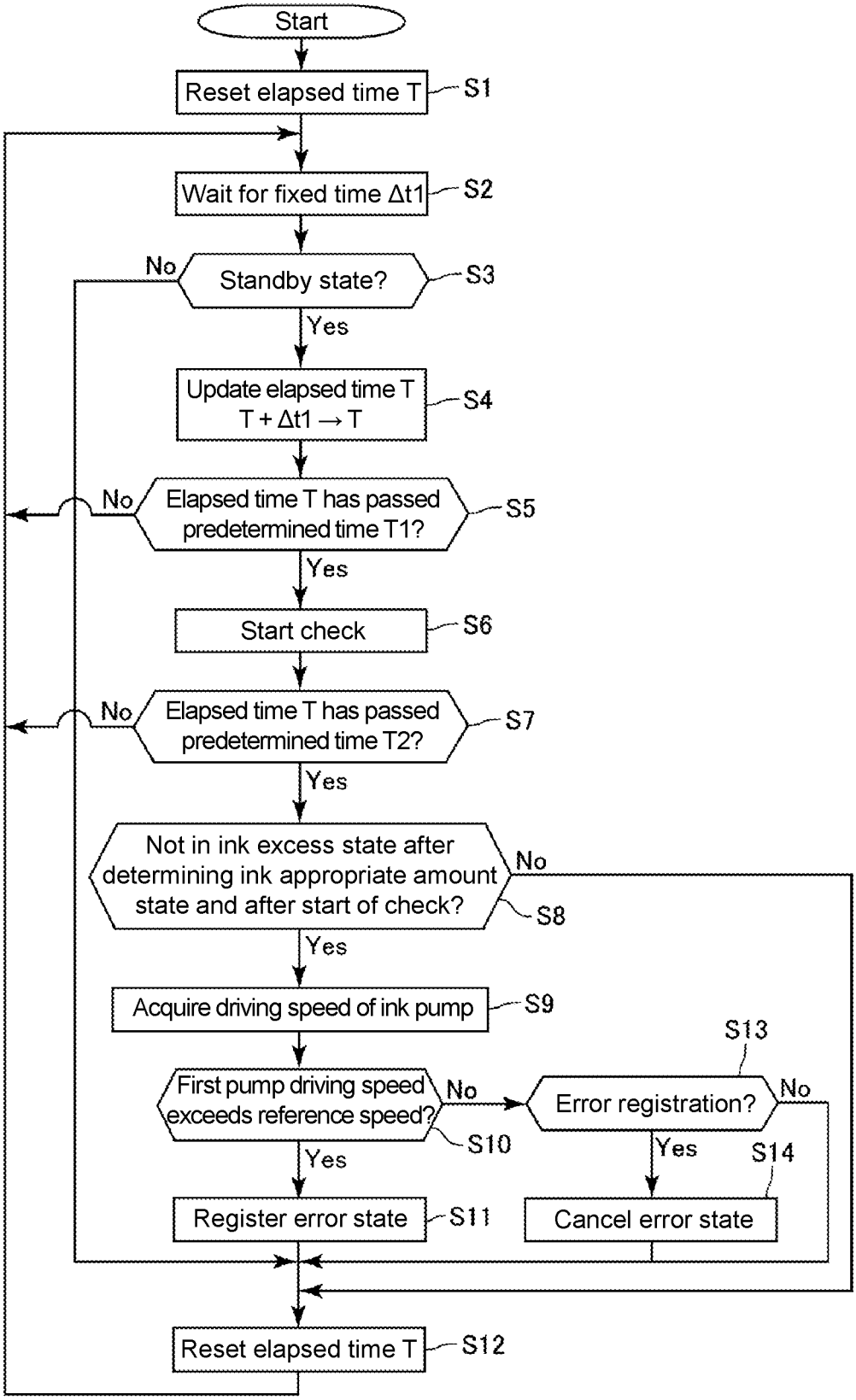
FIG. 3 is a flow chart showing an example of a control of the inkjet printer associated with a checking operation of a driving speed of an ink pump shown in FIG. 1.

FIG. 3 is a flowchart showing an example of a control of the inkjet printer 1 associated with a checking operation of the driving speed of the ink pump 13 shown in FIG. 1.

In the present embodiment, the control unit 21 acquires the first pump driving speed of the ink pump 13 when the printer 1 is in the ink appropriate amount state at a predetermined time interval, and compares it with a predetermined reference speed and executes a predetermined error processing when the first pump driving speed exceeds the reference speed. That is, the control unit 21 checks the first pump driving speed of the ink pump 13 almost regularly, and executes the predetermined error processing when the first pump driving speed exceeds the reference speed.

Specifically, first, when the printer 1 is activated, the control unit 21 resets the elapsed time T to "0" (step S1). Thereafter, after waiting for a fixed time Δt1 to elapse (step S2), the control unit 21 determines whether the printer 1 is in the standby state (step S3). That is, in step S3, the control unit 21 determines whether the printer 1 is in a state where ink is not ejected from the nozzle unit 5 before the start of printing or after the end of printing. The fixed time Δt1 is a short time, for example, less than one second.

When the printer 1 is in the standby state in step S3, the control unit 21 updates the elapsed time T (step S4). Specifically, in step S4, the control unit 21 sets a time obtained by adding the fixed time Δt1 to the elapsed time T reset in step S1 as a new elapsed time T. Thereafter, the control unit 21 determines whether the elapsed time T updated in step S4 has passed the predetermined time T1 (step S5). The predetermined time T1 is, for example, 30 minutes.

If the elapsed time T has not passed the predetermined time T1 in step S5, the process returns to step S2. On the other hand, if the elapsed time T has passed the predetermined time T1 in step S5, the control unit 21 starts to check the detection states of the detection mechanisms 11 and 12 (specifically, detection states of the magnetic sensors 18 to 20 and 26 to 28) (step S6). Thereafter, the control unit 21 determines whether the elapsed time T (i.e., elapsed time T updated in step S4) has passed a predetermined time T2 (step S7). The predetermined time T2 is a time obtained by adding a fixed time Δt2 to the predetermined time T1, where the fixed time Δt2 is, for example, one minute. That is, the predetermined time T2 is, for example, 31 minutes.

If the elapsed time T has not passed the predetermined time T2 in step S7, the process returns to step S2. On the other hand, if the elapsed time T has passed the predetermined time T2 in step S7, the control unit 21 determines whether the printer 1 is currently in the ink appropriate amount state, and whether the printer 1 is in the ink excess state after the start of checking the detection states of the detection mechanisms 11, 12 in step S6 (step S8). That is, in step S8, the control unit 21 determines whether the printer 1 is currently in the ink appropriate amount state, and also determines whether the printer 1 has been in the ink excess state until the fixed time Δt2 has further elapsed from the elapse of the predetermined time T1 while the printer 1 is in the standby state (specifically, whether the magnet 17 has been detected by the magnetic sensor 19 and the magnet 25 has been detected by the magnetic sensor 27).

If, in step S8, the printer 1 is in the ink appropriate amount state and the printer 1 has not been in the ink excess state after the start of checking the detection states of the detection mechanism 11, 12 in step S6, the control unit 21 obtains the driving speed of the ink pump 13 (step S9). That is, in step S9, the control unit 21 acquires the first pump driving speed of the ink pump 13. Specifically, in step S9, the control unit 21 acquires the first pump driving speed of the ink pump 13 when the printer 1 is in the standby state.

When the driving speed of the ink pump 13 is acquired in step S9, at least a predetermined time T2 has elapsed since the printer 1 is in the standby state, and the printer 1 has never been in the ink excess state after the check is started in step S6, and hence the ink appropriate amount state is continued for at least a fixed time Δt2. Therefore, the driving speed of the ink pump 13 acquired in step S9 is assumed to be the first pump driving speed when the first ink flow rate, the second ink flow rate, and the third ink flow rate are substantially equal constant flow rate.

Furthermore, the first pump driving speed acquired in step S9 is a set value of the driving speed of the ink pump 13 set by the pump control unit 34 so that the flow rate of the ink supplied from the discharge side sub tank 8 to the supply side sub tank 7 by the ink pump 13 becomes constant, and is not the actual measurement value of the driving speed of the ink pump 13. However, the first pump driving speed acquired in step S9 may be an actual measurement value of the driving speed of the ink pump 13. In this case, the ink pump 13 includes, for example, an encoder for detecting the rotational speed of a motor which is a drive source.

Thereafter, the control unit 21 determines whether the first pump driving speed acquired in step S9 exceeds a predetermined reference speed (step S10). If the first pump driving speed exceeds the reference speed in step S10, the control unit 21 executes a predetermined error processing (step S11). In the present embodiment, in step S11, the control unit 21 registers an error state in the storage unit of the control unit 21. Furthermore, in step S11, the control unit 21 makes an error indication on a predetermined display unit of the printer 1. Thereafter, the control unit 21 resets the elapsed time T to "0" (step S12), and then returns to step S2.

On the other hand, when the first pump driving speed is less than or equal to the reference speed in step S10, the control unit 21 determines whether an error state is registered in the storage unit of the control unit 21 (step S13). If the error state is registered in step S13, the error state registered in the storage unit of control unit 21 is canceled (step S14) and the process proceeds to step S12, whereas if the error state is not registered in step S13, the process directly proceeds to step S12. In step S14, the control unit 21 also erases the error indication displayed on the display unit of the printer 1.

Furthermore, if the printer 1 is not in the ink appropriate amount state or if the printer 1 has been in the ink excess state in step S8, the process proceeds to step S12. If the printer 1 is not in the standby state in step S3, the process also proceeds to step S12. The flow shown in FIG. 3 is executed until the power of the printer 1 is turned off. In step S4 after step S12, the control unit 21 sets a time obtained by adding a fixed time Δt1 to the elapsed time T reset in step S12 as a new elapsed time T. Furthermore, in step S4 immediately after returning from step S5 or S7 to step S2, the control unit 21 sets a time obtained by adding a fixed time Δt1 to the elapsed time T updated in the previous step S4 as a new elapsed time T.

Steps S9 and S10 of the present embodiment are pump speed check steps in which the first pump driving speed is acquired at a predetermined time interval and compared with a predetermined reference speed, and step S11 is an error processing step in which a predetermined error processing is executed when the first pump driving speed exceeds the reference speed. Furthermore, the predetermined time T1 of the present embodiment is a predetermined first time, and the pump speed check step can be executed when the printer 1 is in the standby state and the first time has elapsed (when "Yes" in step S5).

Furthermore, the pump speed check step is executed when the fixed time Δt2 of the present embodiment is a predetermined second time, and the printer 1 is not in the ink excess state and the printer 1 is in the ink appropriate amount state until the second time has further elapsed from the elapse of the first time while the printer 1 is in the standby state (when "Yes" in step S8). Moreover, in the present embodiment, in the pump speed check step executed after the error processing execution step, the error state registered in the control unit 21 is canceled when the first pump driving speed is less than or equal to the reference speed (step S9, S10, S13, S14).

(Main Effects of Present Embodiment)

In the present embodiment, the ink is supplied from the discharge side sub tank 8 to the supply side sub tank 7 at a constant flow rate by the ink pump 13 when the printer 1 is in the ink appropriate amount state. Furthermore, in the present embodiment, the first pump driving speed which is the driving speed of the ink pump 13 when the printer 1 is in the ink appropriate amount state is acquired at a predetermined time interval and compared with a predetermined reference speed, and a predetermined error processing is executed when the first pump driving speed exceeds the reference speed. Thus, in the present embodiment, the user of the printer 1 can sense that the ejection performance of the ink pump 13 is starting to degrade before the ejection performance of the ink pump 13 degrades to an extent the printer 1 comes to a stop.

That is, when the printer 1 is in the ink appropriate amount state, the ink pump 13 supplies ink at a constant flow rate from the discharge side sub tank 8 to the supply side sub tank 7, and hence the first pump driving speed, which is the driving speed of the ink pump 13 when the printer 1 is in the ink appropriate amount state, becomes faster as the ejection performance of the ink pump 13 degrades. Therefore, as in the present embodiment, the first pump driving speed is acquired at a predetermined time interval and compared with a predetermined reference speed, and a predetermined error processing is performed when the first pump driving speed exceeds the reference speed, so that the user of the printer 1 can sense that the ejection performance of the ink pump 13 is starting to degrade before the ejection performance of the ink pump 13 degrades to an extent the printer 1 comes to a stop. Therefore, in the present embodiment, when the user senses that the ejection performance of the ink pump 13 is starting to degrade, the user carries out a predetermined operation such as maintenance or replacement of the ink pump 13 to prevent the printer 1 from stopping due to decrease in the feeding amount of the ink of the ink pump 13.

In the present embodiment, when the predetermined time T1 has elapsed while the printer 1 is in the standby state, step S9 can be executed. The driving speed of the ink pump 13 that feeds the ink from the discharge side sub tank 8 to the supply side sub tank 7 based on the detection results of the detection mechanisms 11, 12 is less likely to stabilize before elapse of a fixed time after the activation of the printer 1 and before elapse of a fixed time after the end of printing, but the driving speed of the ink pump 13 easily stabilizes after elapse of a predetermined time T1 in the standby state. Therefore, in the present embodiment, the first pump driving speed can be appropriately acquired in step S9.

In the present embodiment, the pump speed check step is executed when the printer 1 has not become the ink excess state until the fixed time Δt2 has further elapsed from the elapse of the predetermined time T1 while the printer 1 is in the standby state. When the printer 1 is in the ink excess state, the amount of ink in the discharge side sub tank 8 needs to be reduced and the amount of ink in the supply side sub tank 7 also needs to be reduced, and hence the driving speed of the ink pump 13 is unstable when the printer 1 is in the ink excess state even after the predetermined time T1 has elapsed while the printer 1 is in the standby state, but the driving speed of the ink pump 13 easily stabilizes if the printer 1 is not in the ink excess state until a fixed time Δt2 has further elapsed from after elapse of the predetermined time T1 while the printer 1 is in the standby state. Therefore, in the present embodiment, the first pump driving speed can be appropriately acquired in step S9.

In the present embodiment, in the pump speed check step executed after the error processing execution step, the error state registered in the control unit 21 is canceled when the first pump driving speed is less than or equal to the reference speed. Therefore, in the present embodiment, when an error occurs such as the first pump driving speed acquired in the previous step S9 being inappropriate, or the comparison result between the first pump driving speed and the reference speed in the previous step S10 being inappropriate, and the like, such error can be corrected.

OTHER EMBODIMENTS

The above-described embodiments are examples of a preferred embodiment of the present disclosure, but the present disclosure is not limited thereto, and various modifications can be made without changing the gist of the present disclosure.

In the embodiment described above, the control unit 21 registers an error state in the storage unit of the control unit 21 and displays an error indication on the display unit of the printer 1 in step S11, but the control unit 21 may inform the maintenance person of the printer 1 through e-mail and the like that the ejection performance of the ink pump 13 is starting to degrade in place of displaying an error indication on the display unit of the printer 1 or in addition to displaying an error indication on the display unit of the printer 1 in step S11. In this case, it is possible to inform, at an early stage, the maintenance person that predetermined operation such as maintenance and replacement of the ink pump 13 is necessary. Therefore, the maintenance person can perform the predetermined operation such as maintenance and replacement of the ink pump 13 earlier, and as a result, the printer 1 can be reliably prevented from stopping due to the decrease in the feeding amount of the ink of the ink pump 13.

In the embodiment described above, the control unit 21 may store the number of times the first pump driving speed exceeds the reference speed, and execute the error processing when the number of times the first pump driving speed exceeds the reference speed reaches a predetermined number of times. In this case, the error processing can be prevented from being executed when an error occurs such as the first pump driving speed acquired in step S9 being inappropriate, or the comparison result between the first pump driving speed and the reference speed in step S10 being inappropriate, and the like.

In the embodiment described above, if the first pump driving speed of the ink pump 13 can be properly acquired in step S9, the process may directly proceed to step S9 when the elapsed time T has passed the predetermined time T1 in step S5, or may directly proceed to step S9 when the printer 1 is in the standby state in step S3. Furthermore, if the first pump driving speed of the ink pump 13 can be appropriately acquired, the control unit 21 may acquire the first pump driving speed of the ink pump 13 when the printer 1 is in the printing state.

In the embodiment described above, when the first pump driving speed is less than or equal to the reference speed in step S10, the process may directly proceed to step S12. In the embodiment described above, the printer 1 may perform two-dimensional printing on a print medium such as printing paper. Furthermore, in the embodiment described above, the printer 1 may be an inkjet printer for general consumers.

What is claimed is:

1. An inkjet printer comprising:

an ink circulation type inkjet head having an ink supply port for supplying ink, an ink discharge port for discharging ink, and a nozzle unit for ejecting ink;

a supply side sub tank that is connected to the ink supply port through a piping and that contains the ink to be supplied to the inkjet head;

a discharge side sub tank that is connected to the ink discharge port through a piping and that contains the ink to be discharged from the inkjet head;

a first detection mechanism for detecting an amount of the ink in the supply side sub tank;

a second detection mechanism for detecting an amount of the ink in the discharge side sub tank;

an ink pump that feeds the ink from the discharge side sub tank to the supply side sub tank based on detection results of the first detection mechanism and the second detection mechanism; and a control unit that controls the inkjet printer, wherein the ink inside the inkjet head is caused to circulate by that a negative pressure inside the discharge side sub tank is a negative pressure larger than a negative pressure inside the supply side sub tank, and the ink moves from the supply side sub tank to the discharge side sub tank through the inkjet head, in a case that a state of the inkjet printer when the first detection mechanism detects that the amount of the ink in the supply side sub tank is an appropriate amount and the second detection mechanism detects that the amount of the ink in the discharge side sub tank is an appropriate amount is referred to as an ink appropriate amount state, when the inkjet printer is in the ink appropriate amount state and a first ink flow rate for supplying ink to the head from the supply side sub tank, a second ink flow rate for discharging ink to the discharge side sub tank from the head and a third ink flow rate for supplying ink to the supply side sub tank from the discharge side sub tank are a substantially equal constant flow rate, the control unit acquires a first pump driving speed, which is a driving speed of the ink pump, at a predetermined time interval and compares the first pump driving speed with a predetermined reference speed, and executes a predetermined error processing when the first pump driving speed exceeds the reference speed.

2. A control method for an inkjet printer, the inkjet printer including:

an ink circulation type inkjet head having an ink supply port for supplying ink, an ink discharge port for discharging ink, and a nozzle unit for ejecting ink;

a supply side sub tank that is connected to the ink supply port through a piping and that contains the ink to be supplied to the inkjet head;

a discharge side sub tank that is connected to the ink discharge port through a piping and that contains the ink discharged from the inkjet head;

a first detection mechanism for detecting an amount of the ink in the supply side sub tank;

a second detection mechanism for detecting an amount of the ink in the discharge side sub tank; and an ink pump that feeds the ink from the discharge side sub tank to the supply side sub tank based on detection results of the first detection mechanism and the second detection mechanism, wherein the ink inside the inkjet head is caused to circulate by that a negative pressure inside the discharge side sub tank is a negative pressure larger than a negative pressure inside the supply side sub tank, and the ink moves from the supply side sub tank to the discharge side sub tank through the inkjet head, and in a case that a state of the inkjet printer when the first detection mechanism detects that the amount of the ink in the supply side sub tank is an appropriate amount and the second detection mechanism detects that the amount of the ink in the discharge side sub tank is an appropriate amount is referred to as an ink appropriate amount state, and the inkjet printer is in the ink appropriate amount state, and a first ink flow rate for supplying ink to the head from the supply side sub tank, a second ink flow rate for discharging ink to the discharge side sub tank from the head and a third ink flow rate for supplying ink to the supply side sub tank from the discharge side sub tank are a substantially equal constant flow rate, the control method comprising steps of:

a pump speed check step of acquiring a first pump driving speed, which is a driving speed of the ink pump, when the inkjet printer is in the ink appropriate amount state at a predetermined time interval and comparing the first pump driving speed with a predetermined reference speed; and an error processing execution step of executing a predetermined error processing when the first pump driving speed exceeds the reference speed.

3. The control method for the inkjet printer according to claim 2, wherein in a case that a state of the inkjet printer when ink is not ejected from the nozzle unit before start of printing or after end of printing is referred to as a standby state, the pump speed check step is in an executable state when a predetermined first time has elapsed in the standby state.

4. The control method for the inkjet printer according to claim 3, wherein in a case that a state of the inkjet printer when the first detection mechanism detects that the amount of the ink in the supply side sub tank exceeds a predetermined reference amount, and the second detection mechanism detects that the amount of the ink in the discharge side sub tank exceeds the predetermined reference amount is referred to as an ink excess state, the pump speed check step is executed when the inkjet printer is not in the ink excess state and the inkjet printer is in the ink appropriate amount state until a predetermined second time has further elapsed from the elapse of the first time in the standby state.

5. The control method for the inkjet printer according to claim 4, wherein in the error processing execution step, an error state is registered in a control unit of the inkjet printer, and in the pump speed check step executed after the error processing execution step, the error state registered in the control unit is cancelled when the first pump driving speed is less than or equal to the reference speed.

6. The control method for the inkjet printer according to claim 3, wherein in the error processing execution step, an error state is registered in a control unit of the inkjet printer, and in the pump speed check step executed after the error processing execution step, the error state registered in the control unit is canceled when the first pump driving speed is less than or equal to the reference speed.

7. The control method for the inkjet printer according to claim 2, wherein in the error processing execution step, an error state is registered in a control unit of the inkjet printer, and in the pump speed check step executed after the error processing execution step, the error state registered in the control unit is canceled when the first pump driving speed is less than or equal to the reference speed.

* * * * *